US006673000B2

(12) United States Patent
Marbach

(10) Patent No.: US 6,673,000 B2
(45) Date of Patent: Jan. 6, 2004

(54) METHOD AND APPARATUS FOR SEPARATING SCRAP CUTTINGS FROM A PANEL THAT WAS PUNCHED OR CUT FROM A SHEET OF MATERIAL AND ARRANGEMENT FOR PRODUCING A PANEL FROM A SHEET OF MATERIAL

(75) Inventor: Peter Marbach, Heilbronn (DE)

(73) Assignee: Karl Marback GmbH & Co. KG (DE)

( * ) Notice: Subject to any disclaimer, the term of this patent is extended or adjusted under 35 U.S.C. 154(b) by 41 days.

(21) Appl. No.: 10/022,279

(22) Filed: Dec. 20, 2001

(65) Prior Publication Data

US 2002/0088320 A1 Jul. 11, 2002

(30) Foreign Application Priority Data

Dec. 28, 2000 (DE) ..... 100 65 457

(51) Int. Cl.[7] ..... B31B 1/14
(52) U.S. Cl. ..... 493/82; 493/83; 493/373
(58) Field of Search ..... 493/82, 83, 373; 83/30, 33, 40, 55

(56) References Cited

U.S. PATENT DOCUMENTS 3,892,153 A * 7/1975 Kato ..... 83/100
4,715,847 A * 12/1987 Focke et al. ..... 493/11
5,402,698 A * 4/1995 Morrison ..... 83/39
5,810,233 A * 9/1998 Varidel ..... 225/97
6,422,793 B1 * 7/2002 Todisco et al. ..... 409/304

FOREIGN PATENT DOCUMENTS

| | | |
|---|---|---|
| DE | 41 24 098 C1 | 1/1993 |
| EP | 1 074 354 A1 | 2/2001 |
| WO | WO 99/29496 A1 | 6/1999 |

* cited by examiner

*Primary Examiner*—Eugene Lee Kim
(74) *Attorney, Agent, or Firm*—Rothwell, Figg, Ernst & Manbeck, P.C.

(57) ABSTRACT

Scrap cuttings are separated from a panel that was punched or cut from a sheet of material by providing a transport device (22) that attracts a sheet of material (10), supported by a platen (15) of a machining device (16), that was punched or cut via the attractive force of a first attraction surface (28). Subsequently, the transport device (22) is moved toward a second attraction surface (39) of a cutting separator (18) until the sheet of material (10) is lying on top of the second attraction surface (39); and the attractive force exerted in this position by the second attraction surface (39) is greater in the area of the cuttings (14) than the attractive force exerted by the first attraction surface (28), and the attractive force exerted by the second attraction surface (39) in the area of the panel (12) is smaller than the attractive force exerted by the first attraction surface (28). Afterwards the transport device (22), including the panel (12), is advanced to a panel stacking device (20), while the scrap cuttings (14) remain on the cutting separator (18), and the attractive force exerted by the first attraction surface (28) is switched off, thereby allowing the panel (12) to be deposited in the panel stacking device (20).

16 Claims, 8 Drawing Sheets

METHOD AND APPARATUS FOR SEPARATING SCRAP CUTTINGS FROM A PANEL THAT WAS PUNCHED OR CUT FROM A SHEET OF MATERIAL AND ARRANGEMENT FOR PRODUCING A PANEL FROM A SHEET OF MATERIAL

BACKGROUND OF THE INVENTION

1. Field of the Invention

The invention relates to a method and an apparatus for separating the scrap cuttings from a panel that was punched or cut from a sheet of material and an arrangement for producing a panel from a sheet of material.

2. Description of the Background Art

Methods known in the art for producing blanks for collapsible folding boxes from cardboard sheets are flatbed-punching methods; they provide that the sheet of cardboard is placed inside a punching tool of a punching machine and onto a platen. Subsequently, a punching template, which is equipped with punching and scoring dies on its underside, is brought downward with great force and punches out panels (usable components).

For the subsequent separation of the sheet of material into panels and scrap cuttings, the sheet is transported to a cutting separator, such as is described, for example, in DE 41 24 098 C1. To prevent the cuttings from becoming separated from the panel during transport to the cutting separator, the punching dies are arranged in the punching template in such a way that, following the punching process, the cuttings remain attached to the panels via small connecting bridges. Thanks to these connecting bridges it is possible to pull the sheet with scrap cuttings and panel out of the punching machine and onto a platen in the cutting separator. Inside the cutting separator, special break-away elements envisioned on a break-away tool are pressed down onto the cutting areas, causing the scrap cuttings to detach at the connecting bridges, dropping through holes in the platen into an open space below.

Each time the cutting separator is adjusted for use with a new blank template, a new break-away tool with correspondingly positioned break-away elements and a new platen that has holes envisioned opposite to the break-away elements are needed. Therefore, implementing the adjustments for a new blank pattern is very complex.

Furthermore, it is difficult to size the connecting bridges. If they are too small, they cannot ensure that the scrap cuttings and the panel are held together, and hence they cannot ensure a secure transport. If they are too large, the connection between the scrap cuttings and the panel is too strong, resulting in quality control problems when the scrap cuttings are separated, i.e. clearly visible remnants of the connecting bridges and fissures that can result due to the large amount of force necessary to break the two apart. Because of the considerable complexity that is involved when the punching tools and the cutting separator are adjusted for a new blank template, the known method and the known apparatus for separating panels from scrap cuttings is only economical for very large production series.

From WO 99/29496 a method is known in the art that provides for the panels to be cut from a sheet of material by way of contact-free cutting, e.g. by way of laser cutting, water torches, dry ice or dry air; and the cutting process is implemented using a freely programmable machining device that is controlled by a computer.

SUMMARY OF THE INVENTION

The subject-matter of the present invention provides a method and a reliable apparatus, using simple means in terms of their construction, for separating scrap cuttings from a panel that was punched out or cut from a sheet of material and that are easily adjustable to accommodate a new blank template.

The method according to the invention is quickly and easily adjustable to accommodate a new blank template. For example, all that is required is that the second attraction surface of the cutting separator is adjusted in order to coordinate it with the geometry of the panels and scrap cuttings in the sheet of material.

If a vacuum device with a suction opening is envisioned in the cutting separator as the attraction device, the adjustment is easily achieved by covering up the areas allocated to the panel with a masking device whose air permeability level is lower than the air permeability of the suction opening.

Only minimal suction forces are necessary if the suction opening in the transport device is equipped in the area of the scrap cuttings with a partially air-permeable masking, and if the suction opening in the cutting separator is equipped in the area of the panel with a masking that is air-tight.

To separate the scrap cuttings from the panel, the transport device is moved in the direction toward the cutting separator until the sheet of material rests on top the attraction surface of the cutting separator. Afterwards the transport device is moved toward the panel-stacking device. Because the cutting separator exerts a greater attractive force on the scrap cuttings than the transport device, the cuttings remain on the cutting separator. The panels, however, continue to adhere to the attraction surface of the transport device, since the attractive force exerted by the attraction surface of the transport device is greater than the force exerted by the attraction surface of the cutting separator. The attractive force exerted by the attraction surface of the transport device is switched off in the panel-stacking device, causing the panels to fall away from this attraction surface and become deposited in the panel-stacking device.

In a preferred arrangement, a computer-controlled machining device separates the sheets of material in one cutting template in a contact-free way into panels and scrap cuttings. The same template can be used for produce the masking, resulting in a considerably reduction of the expenditure and effort that is required for adjusting a new blank template. Advantageously, the masking includes a bonding sheet with a coating on one side which the machining tool pastes onto the suction opening of the cutting separator after the cutting process.

To automate the production of panels from a sheet of material, it is advantageous to envision a panel-stacking device that can be gradually lowered in relation to the respective corresponding panel thickness, thereby allowing that the panels are always stacked on top of each other at the same height in relation to the transport device. It is also useful to provide the cutting separator with a swing device allowing it to move to a swing position in which the scrap cuttings are allowed to drop off from the attraction surface by virtue of gravity, when the attraction device on the cutting separator is switched off.

BRIEF DESCRIPTION OF THE DRAWINGS

An embodiment of the invention will be described in greater detail below in reference to the drawings. Shown are in.

DETAILED DESCRIPTION OF THE INVENTION

Figure 1:
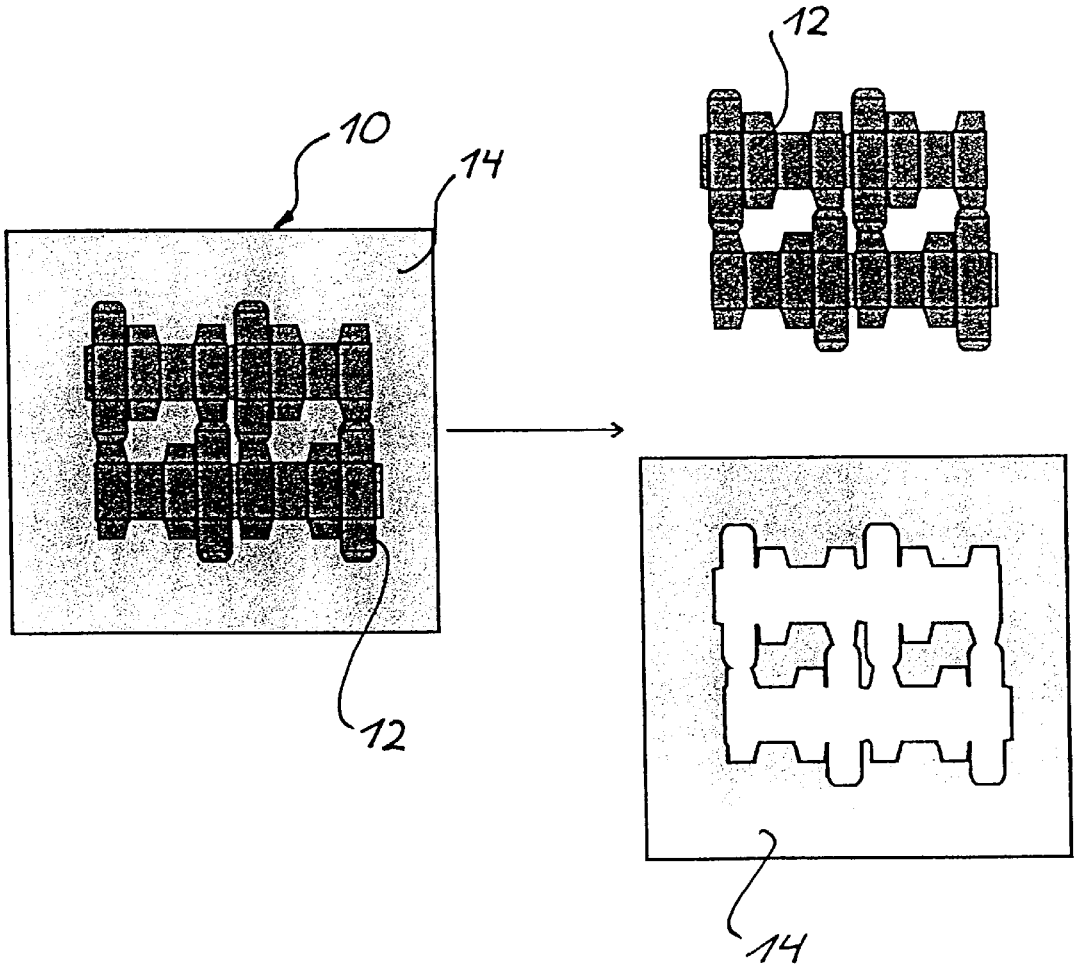
FIG. 1 a schematic depiction of the separation of a sheet of material into panel and scrap cuttings.

FIG. 1 is a schematic representation of the separation of a sheet of material 10 into a panel 12 and scrap cuttings 14. A machining device cuts the panel 12, for example, along its outer contours out of the sheet of material 10, as seen in WO 99/29496. Subsequently, the panels 12 are separated from the scrap cuttings 14.

Figure 2:
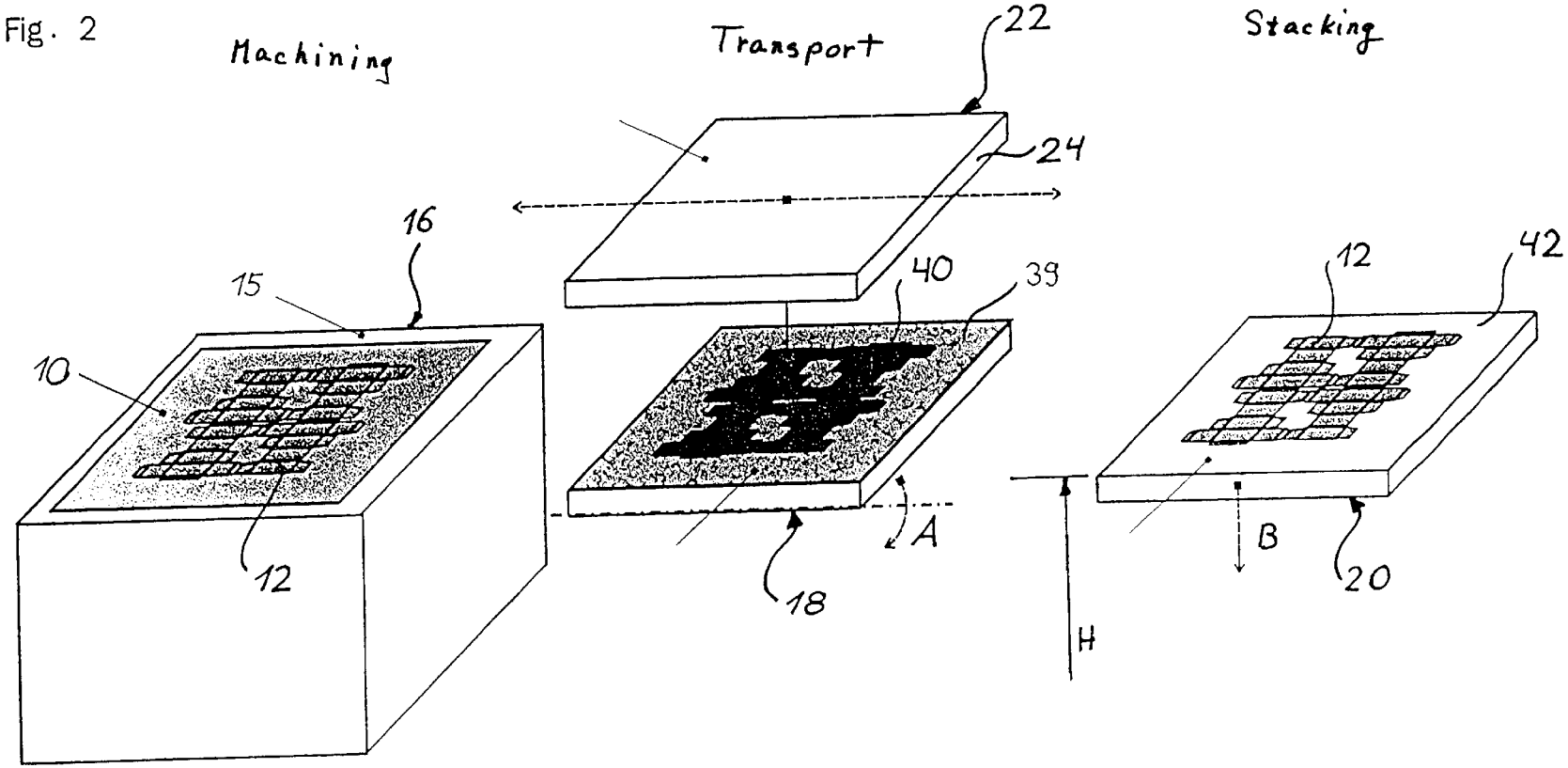
in FIG. 2 a schematic depiction of the construction of an arrangement for producing panels from a sheet of material.

FIG. 2 is a schematic representation of an arrangement for producing a panel from a sheet of material. As basic elements, the arrangement consists of a machining device 16, in which panels 12 are cut along their outer contours out of the sheet of material 10; and fold lines are formed in the panel 12 via the contact-free removal of material from the sheet of material; a cutting separator 18, in which the panel 12 is separated from the scrap cuttings 14; and a panel stacking device 20, in which the panels 12 are stacked one on top of the other. In addition, a transport device 22 is envisioned, which advances the sheet of material 10 from the machining device 16 to the cutting separator 18 and transports the panels 12 from the cutting separator 18 to the panel-stacking device 20.

A laser device can be used as a machining device 16, as described e.g. in WO 99/29496. With this laser device, the cuts and fold lines are carried out with a laser beam that is generated in a resonator and expanded to a multiple of its original diameter before striking a beam deflection system, which is formed by two computer-controlled reflectors, deflecting the laser beam in the x or y direction. The laser beam is focused onto the sheet that to be processed and on which it generates freely programmable fold lines and cuts by way of a flat field optic that is turned to face the sheet of material.

Figure 8:
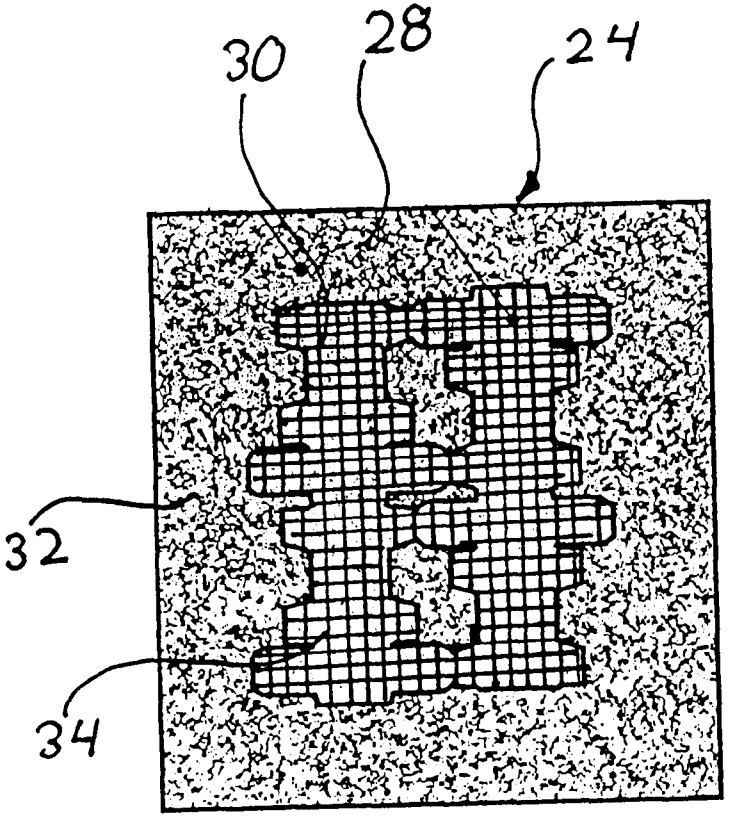
FIG. 8 a view from below of a vacuum suction plate of a transport device.

The transport device 22 is comprised of a vacuum suction plate 24 that is connected to a negative pressure device (not illustrated here). On its underside, the vacuum suction plate has a flat suction surface 28 (FIG. 8), which is formed by a suction opening and limited toward the bottom by a grid 30. A masking 32 made of a partially air-permeable material is pasted to the grid 30. In its center region, the masking 32 has a cutout 34, whose position and shape correspond to the shape of the panel 12 in the sheet of material 10.

The shape and the size of the suction surface 28 of the vacuum suction plate 24 correspond basically to the size and shape of the sheet of material 10.

Figure 9:
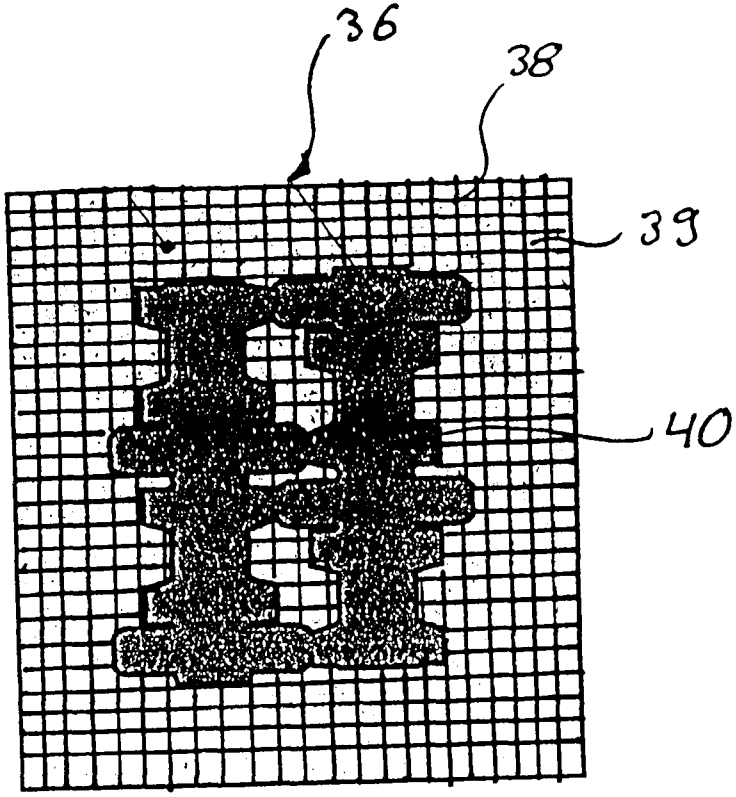
FIG. 9 a top view of a vacuum suction plate of a cutting separator.

The cutting separator 18 is also equipped with a vacuum suction plate 36, whose setup corresponds to that of the vacuum suction plate 24. As seen in FIG. 9, a masking 40 made of an airtight material is positioned on the grid 38 of the suction surface 39 that limits the suction opening; the shape and position of this masking correspond precisely to the shape and position of the panel 12 in the sheet of material 10. The size and shape of the suction surface 39 of the vacuum suction device 36 correspond essentially to the shape and size of the sheet of material 10. The masking 40 is attached to the grid 38 corresponding to the position of the panel 12 in the sheet of material 10.

As is indicated in FIG. 2 with the arrow A, the vacuum suction plate 36 can be swung at a 90° angle around a horizontal axis. The panel-stacking device 20 is equipped with a flat stacking plate 42, and the panels 12 are stacked here, one on top of the other. As is indicated with arrow B in FIG. 2, the stacking plate 22 can be gradually displaced in a vertical direction using a lifting device (not shown here).

Figure 3:
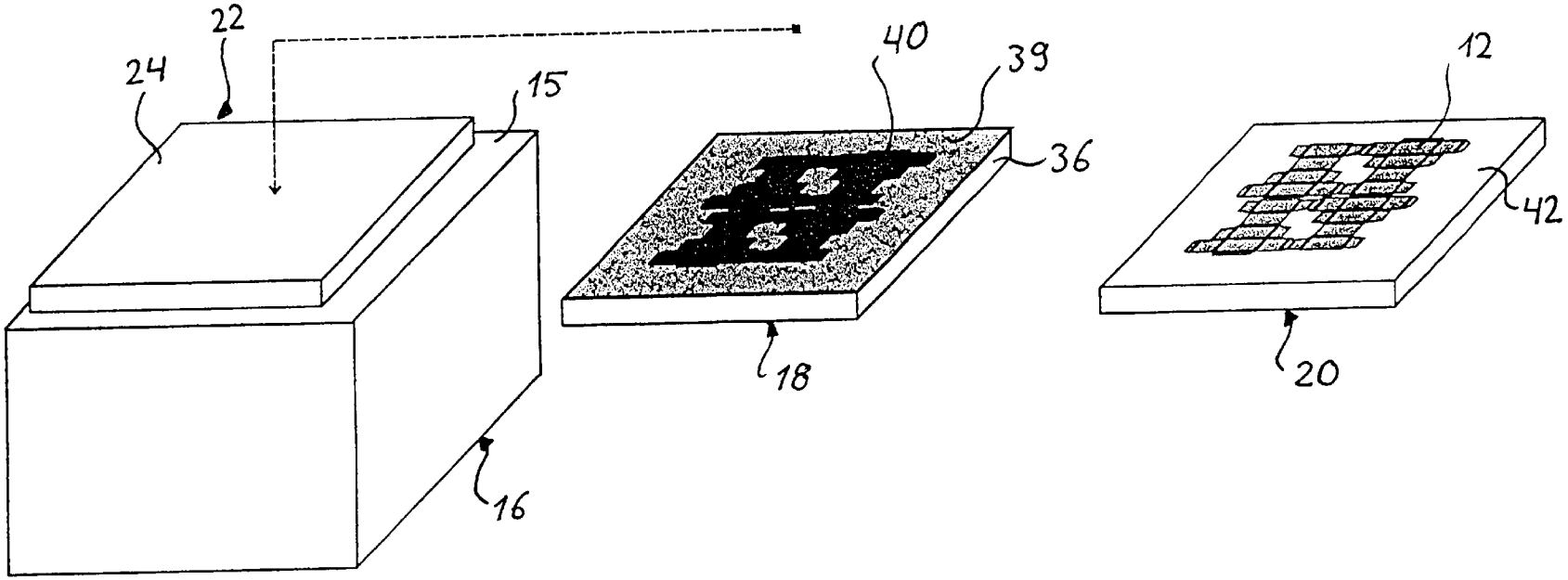
FIG. 3 a schematic depiction of a first process step of the arrangement shown in FIG. 2.

As shown in FIG. 3, the vacuum suction plate 24 is lowered down to the flat platen 15 of the machining device 16 above the sheet of material 10 in order to remove a sheet of material 10 that was processed. During this lowering motion, the cutout 34 of the masking 32 is congruent with the panel 12. Afterwards the negative pressure device, which is connected to the vacuum suction plate 24, is switched on, causing the sheet of material 10 (panel 12 and scrap cuttings 14) to be suctioned. Because the suction force is reduced in the area of the masking 32 due to its partial air permeability, the suction force that is exerted on the scrap cuttings 14 is less than the suction force that is exerted on the panel 12, resting directly on the grid 30.

Figure 4:
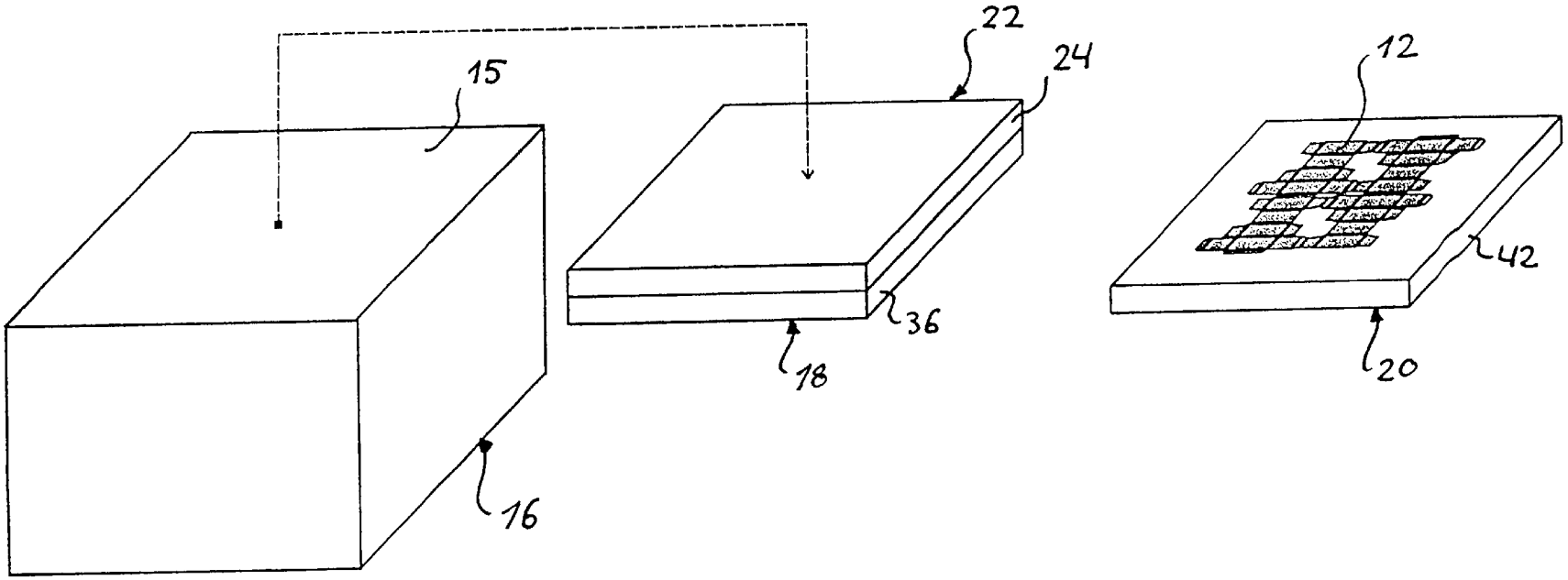
in FIG. 4 a schematic depiction of a second process step of the arrangement shown in FIG. 2.

Thereafter, the vacuum suction plate 24 is advanced in the direction of the cutting separator 18 and lowered to the level of the vacuum suction plate 36 in such a way that the panel 12 comes to rest congruently with the masking 40 (FIG. 4). Now, the negative pressure device of the vacuum suction plate 36 is activated. Since the masking 40 is airtight, no suction force acts upon the panel 12 that adheres to the suction surface 28 of the vacuum suction plate 24. The suction force in the area of the suction surface 39 of the vacuum suction plate 36 surrounding the masking 40 is greater than the suction force acting upon the scrap cuttings that are adhering to the suction surface 28 in the area surrounding the masking 32.

Figure 5:
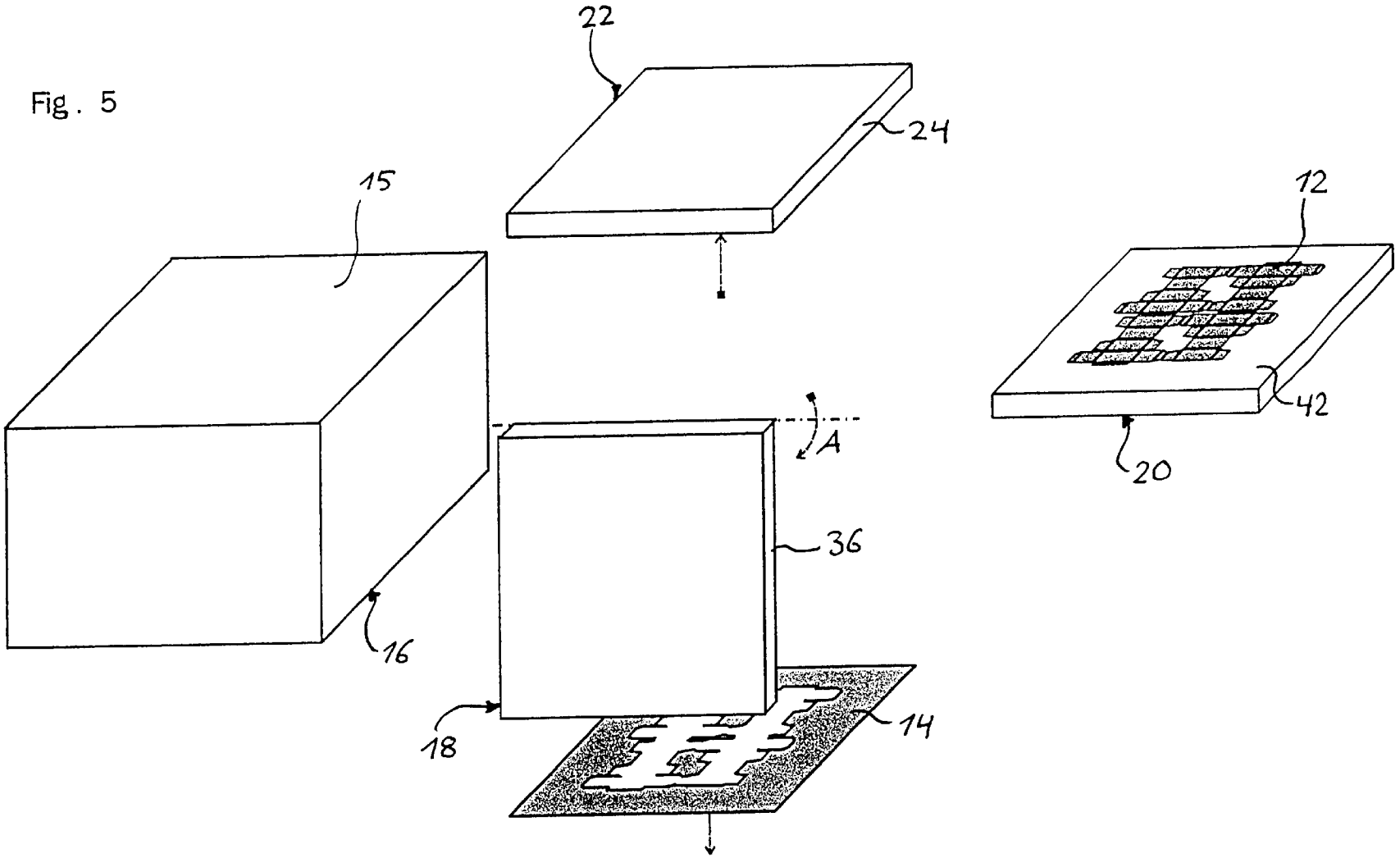
in FIG. 5 a schematic depiction of a third process step of the arrangement shown in FIG. 2.

The vacuum suction device 24 is then moved away from the vacuum suction device 36 in a vertical direction (FIG. 5), while the scrap cuttings stay on the vacuum suction plate [36], due to the greater suction force being exerted by the vacuum suction plate 36. The panel 12 continues to adhere to the cutout 34 of the suction surface 28 of the vacuum suction device 24.

At the same time, the vacuum suction plate 36 is swung at a 90° angle around a horizontal axis, and the negative pressure device that is connected to the vacuum suction plate 36 is switched off. Since no suction force is acting upon the suction opening 38 any longer, the scrap cuttings 14 slide downward and can be collected in a waste receptacle (not shown here).

Figure 6:
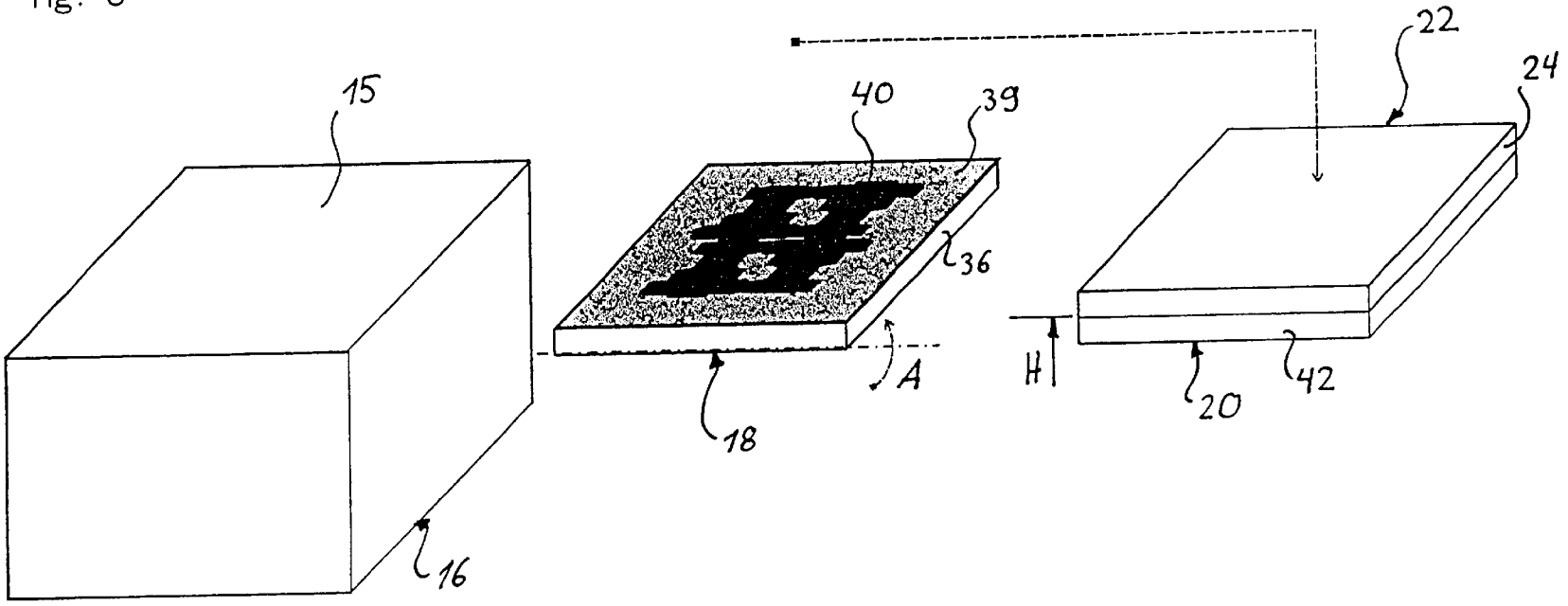
in FIG. 6 a schematic depiction of a fourth process step of the arrangement shown in FIG. 2.

Subsequently, the vacuum suction plate 24 in the cutting separator 22 is moved over the platen 42 of the panel-stacking device 20 and lowered until the suction surface 28 is at the deposition height H (FIG. 6). This deposition height H is selected accordingly so that when the first panel 12 is placed on the platen 42, the distance between the supporting surface of the platen 42 and the suction surface 28 corresponds to the thickness of the panel 12. To allow for additional stacking of panels 12, one on top of the other, the platen 42 can be gradually moved downward in a vertical direction using the lifting device, and the path of the downward movements corresponds to the thickness of the panel 12. This ensures that the platen 42 only needs to be lowered to the level of the deposition height H each time in order to allow for the panels 12 to be stacked.

Figure 7:
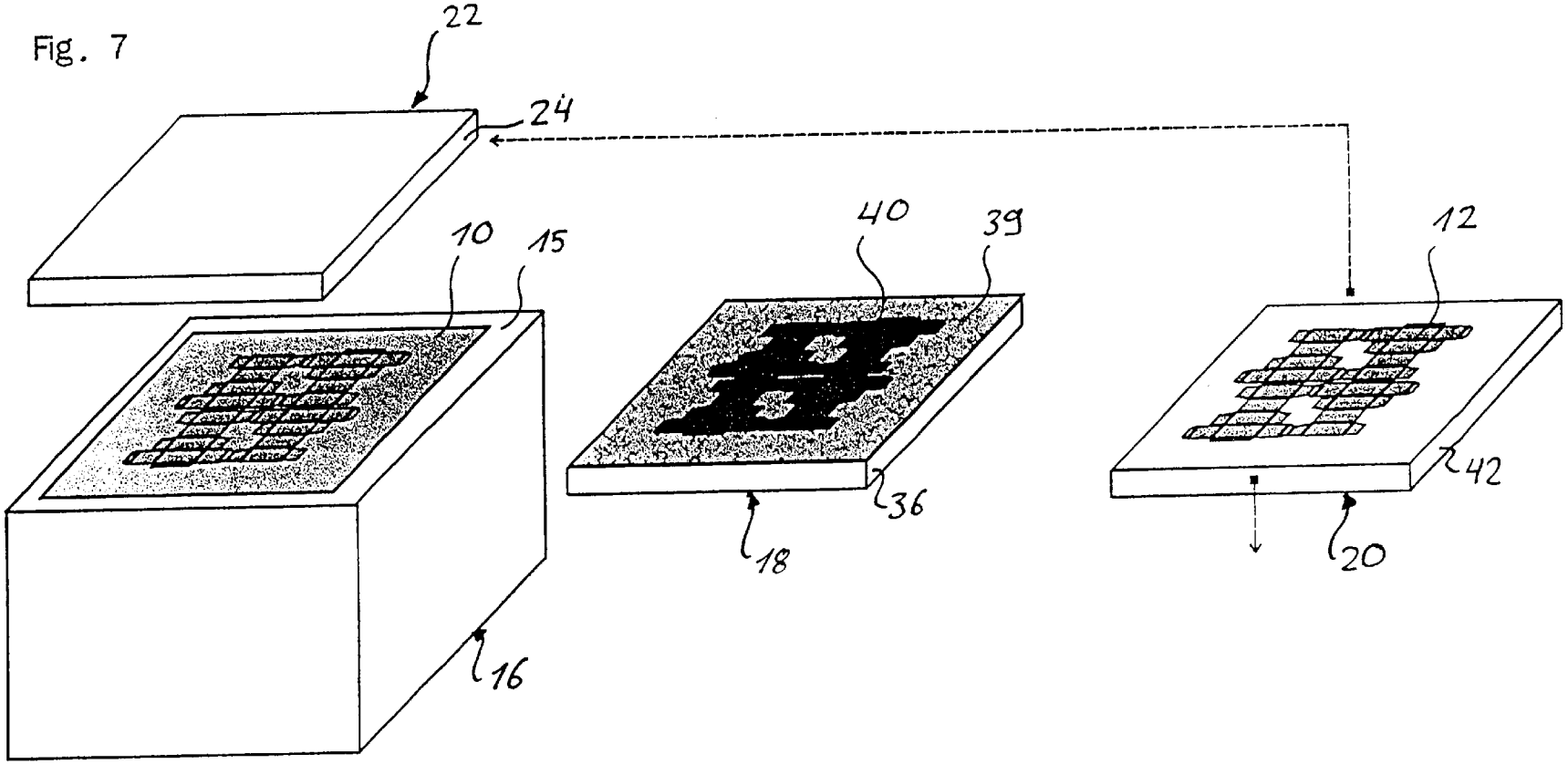
FIG. 7 a schematic depiction of a fifth process step of the arrangement shown in FIG. 2.

After the panels 12 have been deposited on the stack, the vacuum suction plate 24 is moved back to the machining device 16, and another sheet of material 10 has already been processed (FIG. 7) in the machining device.

The maskings 32 and 40 can be easily produced with the machining unit 16. To accomplish this, the masking material, corresponding in terms of shape and size to the sheet of material 10, is placed on the platen 15 of the machining device 16, in particular in such a way that its position corresponds to the position of a sheet of material 10 that is to be processed. The material is subsequently cut, using a laser beam, in correspondence with the template programming envisioned for the cutout of the panel 12 from the sheet of material 10. Therefore, the maskings 32 and 40 can be produced without great labor-related expense and effort by using previously existing programming.

The materials that are used for the maskings 32, 40 are selected appropriately to ensure they are suitable for being cut with the machining device 16. To avoid unevenness that is too great, the material should be as thin as possible. A sheet of cardboard of 0.5 mm thickness can be used, for example, as an airtight material for the masking 40. This corresponds to a standard cardboard sheet generally used for collapsible folding cardboard boxes. A bonding sheet that is coated on only one side is especially well suited as a material for the masking 40 on the vacuum suction plate 36 of the cutting separator 18. To produce the masking, the bonding sheet is placed on top of the platen 15 of the machining device 16; then the protective film covering the adhesive layer is removed. Afterwards the machining device 16 cuts the bonding sheet, using the template that is stored in the computer. The scrap cuttings are removed manually, leaving only the masking 40 behind on the platen 15. The vacuum suction plate 24 is replaced with the vacuum suction plate 36 and transported over the platen 15 of the machining device 16 and lowered. This way, the masking 40 becomes glued to the grid of the suction opening 38. The vacuum suction plate 36 is then reattached to the cutting separator 18.

To produce the masking 32 of the vacuum suction plate 24 of the transport device 22, a partially air-permeable material, which is coated on one side with an adhesive, is placed on top of the platen 15 of the machining device 16; and the material is cut out using the template that is stored in the computer. Subsequently, the areas that correspond to the shape of the panel 12 are removed. The vacuum suction plate 24 is advanced by way of the transport device 22 over the machining device 16 and lowered. This causes the remaining masking material, the shape of which corresponds to the shape of the scrap cuttings, to be glued to the vacuum suction plate 14. Thin paper, cardboard material with air holes or a similar permeable tissue may be used as partially air-permeable material.

What is claimed is:

1. Method for separating scrap cuttings from a panel that was punched or cut from a sheet of material, in which a sheet of material, that is lying on a platen of a machining device and that was punched or cut, is drawn to a first attraction surface of a transport device via attractive force, the transport device is moved toward a second attraction surface of a cutting separator until the sheet of material is lying on the second attraction surface; and the attractive force exerted on the second attraction surface is greater in the area of the scrap cuttings than the attractive force exerted by the first attraction surface and smaller in the area of the panel than the attractive force exerted by the first attraction surface, the transport device is moved to a panel stacking device with the panel, and the scrap cuttings remain on the cutting separator, and the attractive force exerted by the first attraction surface is switched off, causing the panel to be deposited in the panel stacking device.

2. Method according to claim 1 wherein the attractive force exerted by the first attraction surface in the area of the scrap cuttings is smaller than in the area of the panel.

3. Method according to claim 1 wherein no attractive force is exerted by the second attraction surface in the area of the panel.

4. Method according to claim 1 wherein the attraction occurs with electrostatic force.

5. Method according to claim 1 wherein the attraction is produced by way of negative pressure.

6. Apparatus for separating scrap cuttings from a panel that was punched or cut from a sheet of material comprised of a movable transport device with a first attraction device, that can be switched on and off, comprised of a first attraction surface for attracting a punched or cut sheet of material, a cutting separator with a second attraction device, that can be switched on and off, comprised of a second attraction surface, and the attractive force exerted by the second attraction surface is arranged such that the attractive force exerted in an area allocated to the scrap cuttings is greater than the attractive force exerted by the first attraction surface, and the attractive force exerted in an area allocated to the panel is smaller than the attractive force exerted by the first attraction surface.

7. Apparatus according to claim 6 wherein the first attraction device is equipped with a first vacuum device that has a first suction surface covered with a masking in order to create the first attraction surface in the area allocated to the scrap cuttings, and the masking's air permeability is lower than the air permeability of the first suction surface.

8. Apparatus according to claim 6 wherein the second attraction device is equipped with a second vacuum device that has a second suction surface covered with a masking in order to create the second attraction surface in the area allocated to the panel, and the masking's air permeability is lower than the air permeability of the second suction surface.

9. Apparatus according to claim 8 wherein the masking that covers the second suction surface in the area allocated to the panels is airtight.

10. Apparatus according to claim 6 wherein the cutting separator can be swung into a swing position from where the scrap cuttings can fall away from the attraction surface by virtue of gravity, when the second attraction device is switched off.

11. Apparatus according to claim 6 wherein the transport device stacks the panels, one on top of the other, in a panel stacking device, and the panel stacking device can be gradually lowered, with each increment corresponding to the thickness of a panel.

12. Arrangement for producing panels from a sheet of material, comprised of a computer-controlled machining device by way of which panels are cut, in a contact-free process and using a preset template, from a sheet of material that is supported on a platen while producing cuttings, a movable transport device with a first suction device, that can be switched on and off, comprised of a first suction surface, a cutting separator with a second suction device, that can be switched on and off, comprised of a second suction surface, which is covered by a masking in an area that is allocated to the panel of the sheet of material, in particular in such a way that the suction force exerted in this area is smaller than the suction force exerted by the first suction surface, and the transport device is movable in relation to the platen and the cutting separator.

13. Arrangement according to claim 12 wherein the first suction surface is covered by a masking in an area that is allocated to the scrap cuttings, and the air permeability of the masking is lower than the air permeability of the first suction surface.

14. Arrangement according to claim 12 wherein the transport device deposits the panels, one on top of the other, on a panel stacking device, and the panel stacking device can be gradually lowered, with each increment corresponding to the panel thickness.

15. Arrangement according to claim 12 wherein machining device cuts the masking out of a masking material according to the template that is used to cut the panel from the sheet of material.

16. Arrangement according to claim 15 wherein the masking material comprises a bonding sheet that is coated on one side.

* * * * *